United States Patent [19]

Adams, Jr.

[11] 4,378,931

[45] Apr. 5, 1983

[54] VALVE AND ACTUATOR THEREFOR

[75] Inventor: James B. Adams, Jr., Lewisville, Tex.

[73] Assignee: Otis Engineering Corporation, Dallas, Tex.

[21] Appl. No.: 156,200

[22] Filed: Jun. 3, 1980

[51] Int. Cl.[3] ..... F16K 31/122

[52] U.S. Cl. ..... 251/58; 137/495; 166/322; 166/323; 166/332; 251/63.6; 251/94

[58] Field of Search ..... 137/495, 629; 166/323, 166/319, 332, 322; 251/58, 62, 63, 89, 89.5, 94, 95, 63.4, 63.6, 63.5

[56] References Cited

U.S. PATENT DOCUMENTS

| | | | |
|---|---|---|---|
| 3,360,235 | 12/1967 | Myers | 251/95 |
| 3,583,442 | 6/1971 | Dollison | 137/629 |
| 3,696,868 | 10/1972 | Taylor, Jr. | 166/322 |
| 3,703,193 | 11/1972 | Raulins | 137/630 |
| 3,806,082 | 4/1974 | Kellner | 251/58 |
| 3,835,925 | 9/1974 | Mott | 166/323 |
| 3,865,141 | 2/1975 | Young | 137/629 |
| 3,941,348 | 3/1976 | Mott | 251/58 |
| 4,062,406 | 12/1977 | Akkerman et al. | 166/323 |
| 4,130,166 | 12/1978 | Akkerman et al. | 166/324 |
| 4,197,879 | 4/1980 | Young | 137/629 |

*Primary Examiner*—George L. Walton

*Attorney, Agent, or Firm*—Vinson & Elkins

[57] ABSTRACT

A valve and particularly a safety valve for use in controlling flow from a well in which an external motor is utilized to shift the actuator of a valve such as a ball valve. The reciprocating rod of the motor is protected by resilient means between the crosshead attached to the motor and the reciprocating actuator. The actuator is latched when the valve is in the open position so that it cannot be moved to closed position except by movement of the reciprocating motor. The valve and seat assembly are designed to be replaced as a unit and can be fabricated as a subassembly with the valve in exact open alignment when the reciprocating actuator is in full valve open position as determined by a stop against which the valve member bottoms.

The valve may have its actuator moved beyond the normal reciprocating range for opening and closing of the valve member to permanently lock the valve member in full open position without hindering further reciprocation of the actuator so that it can be used as a control for a secondary valve. The housing and actuator are provided with latch means and a secondary valve with a secondary actuator are landed in the housing and in the actuator so that reciprocation of the actuator then moves the secondary valve between open and closed positions.

6 Claims, 8 Drawing Figures

VALVE AND ACTUATOR THEREFOR

This invention relates to safety valves and more particularly to subsurface safety valves utilized to protect a well from some catastrophic occurrence at the surface. As is well known, these valves are utilized to automatically shut-in the well upon the occurrence of any undesired condition at the wellhead, such as loss of pressure resulting from a ship colliding with the wellhead. Upon some undesirable occurrence happening at the wellhead, the subsurface safety valve is automatically closed to shut-in the well and prevent flow therefrom until the causative occurrence can be corrected. It is customary to position these valves at a level a few hundred feet below the wellhead or mudline. Desirably, these valves may also be placed at varying depths in the well, but many problems are encountered when the safety valve is placed at greater than the conventional depth.

To provide a safety valve which may be placed at any desired depth in the well, this invention provides an external reciprocating motor to control the safety valve. The reciprocating motor is operated by fluid on opposite sides of an operating piston to provide for safe dependable operation by controlling the differential pressure in the two lines which lead from the valve to the surface. The pressure in these lines may be controlled in any desired way to shut-in the well at will and to automatically shut-in the well in the event of some catastrophic occurrence at the wellhead.

The provision of an external reciprocating motor for operating the safety valve presents many unique problems which may not be present in conventional safety valves and these problems are solved by the instant invention.

An object of this invention is to provide a subsurface safety valve which may be combined with an externally mounted reciprocating motor in which the connecting rod from the reciprocating motor is protected against an excessive bending force.

Another object is to provide a subsurface safety valve which may be used with an external reciprocating motor in which the connecting rod of the motor is attached to the actuator of the safety valve by a crosshead and force is applied from the crosshead to the actuator through resilient means in both directions to prevent the application of force in excess of a selected value to protect the connecting rod against any excessive forces and particularly to prevent it from being bent by excess force applied between the connecting rod and the valve actuator.

Another object is to provide a subsurface safety valve which is operated by a crosshead in which the valve when in open position is positively latched in open position and cannot be moved to closed position except by movement of the crosshead, thus protecting against closing the safety valve on any TFL tool moving through the valve.

Another object is to provide a subsurface safety valve for use with an external reciprocating motor in which the safety valve may be positively locked in its open position and thereafter a secondary valve run in and landed in the valve housing and the actuator for the secondary valve attached to the actuator of the subsurface safety valve and the valve operated by reciprocation of the actuator of the safety valve.

Another object is to provide a subsurface safety valve in which by moving the valve actuator beyond its normal travel in moving the valve member between open and closed position automatically results in locking of the safety valve in open position while leaving the actuator free to reciprocate, together with suitable landing means in the actuator and in the valve body thus providing for landing of a secondary valve in the valve body and landing of the actuator of the secondary valve in the actuator of the safety valve to permit control of the secondary valve by reciprocation of the safety valve actuator.

Another object is to provide a safety valve in which the actuator when moved beyond the normal range of reciprocation for operating the valve is automatically latched to a sleeve in which the safety valve member is carried and further reciprocation of the actuator reciprocates both the actuator and the sleeve which carries the valve while maintaining the valve member in full open position.

Another object is to provide a safety valve in the preceding object with an automatic release of the sleeve from the valve body when the actuator is moved the extra distance to latch the actuator and sleeve together.

Another object is to provide for a subsurface safety valve, a valve sleeve and stop and valve member assembly in which the relationship of the valve member and its pivot structure to the actuator and sleeve is dimensioned relative to a stop in the valve carrying sleeve such that when the actuator is in its full down position the ball of the valve member has the bore therethrough in exact alignment with the bore through the valve carrying sleeve to protect against hanging up of tools passing through the open valve.

Other objects, features and advantages of this invention will be apparent from the drawing, the specification and the claims.

In the drawings wherein like numerals indicate like parts and wherein an illustrative embodiment of this invention is shown:

Figure 4:
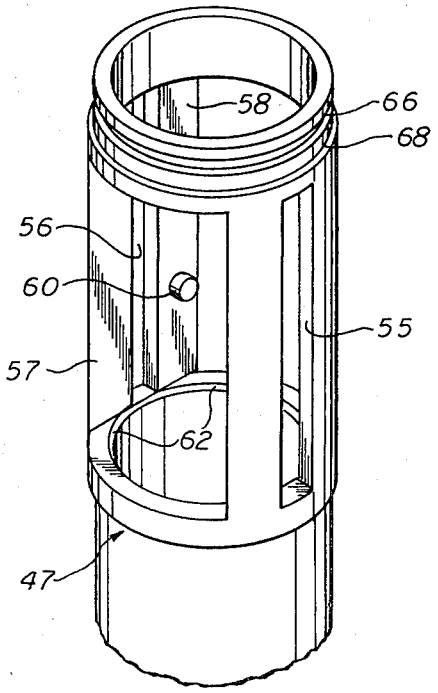
FIG. 4 is an elevational view of the sleeve forming a portion of the valve seat and valve member assembly.
Figure 2A:
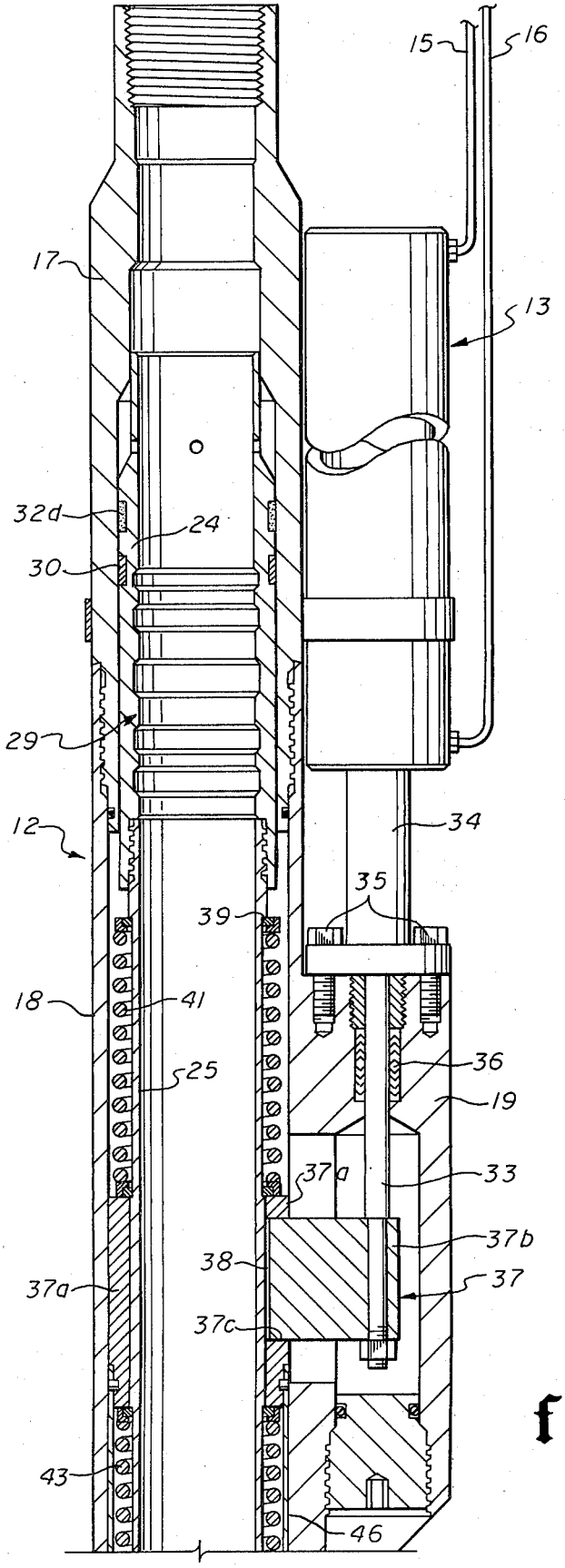
FIGS. 2A, 2B and 2C are continuation views with the reciprocating motor shown in elevation and with the safety valve of this invention shown in section.
Figure 2B:
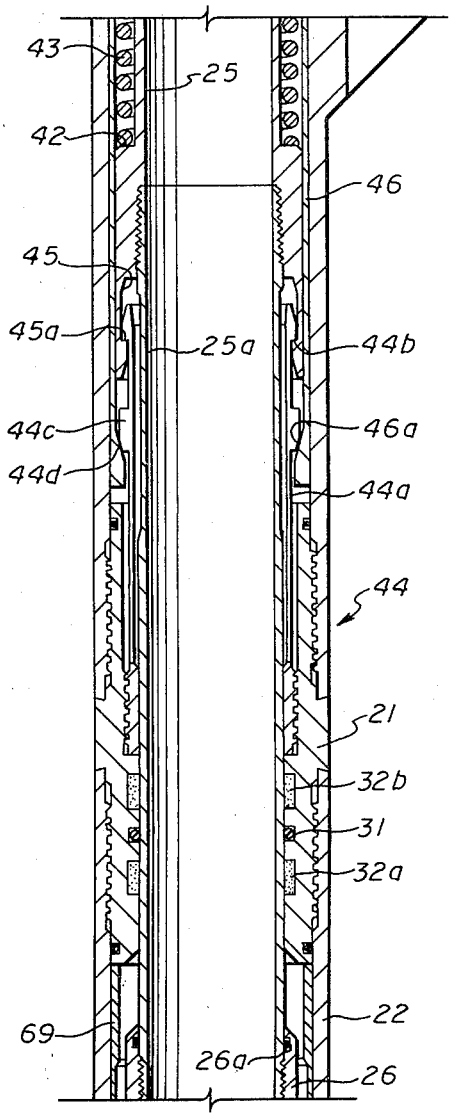
Figure 2C:
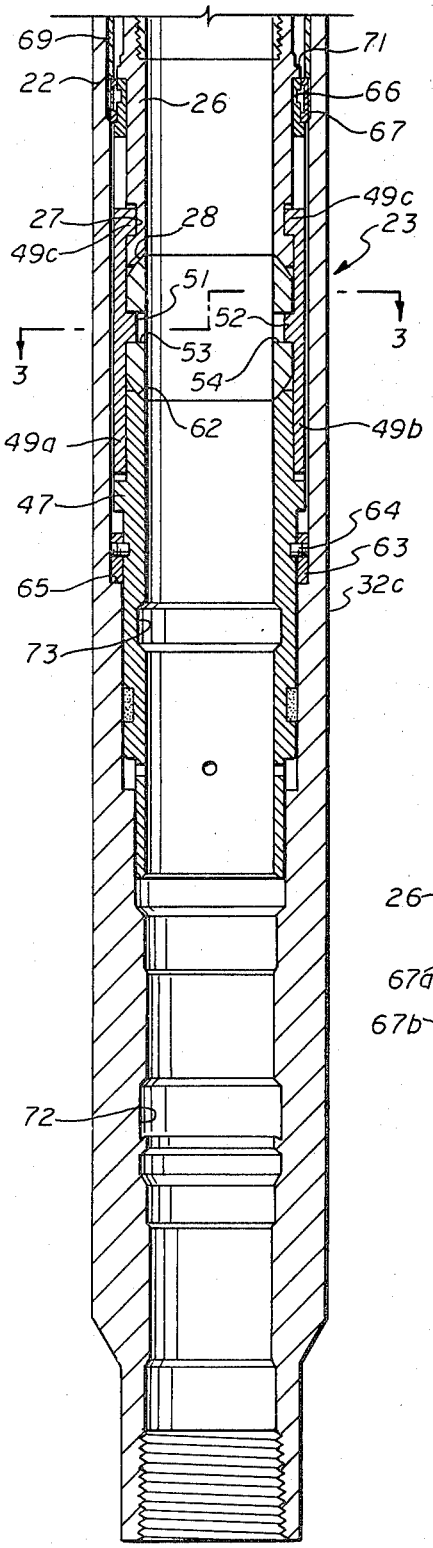
Figure 5:
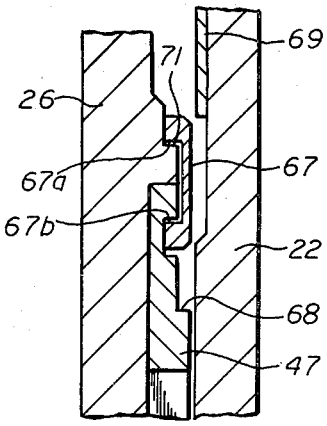
Figure 6:
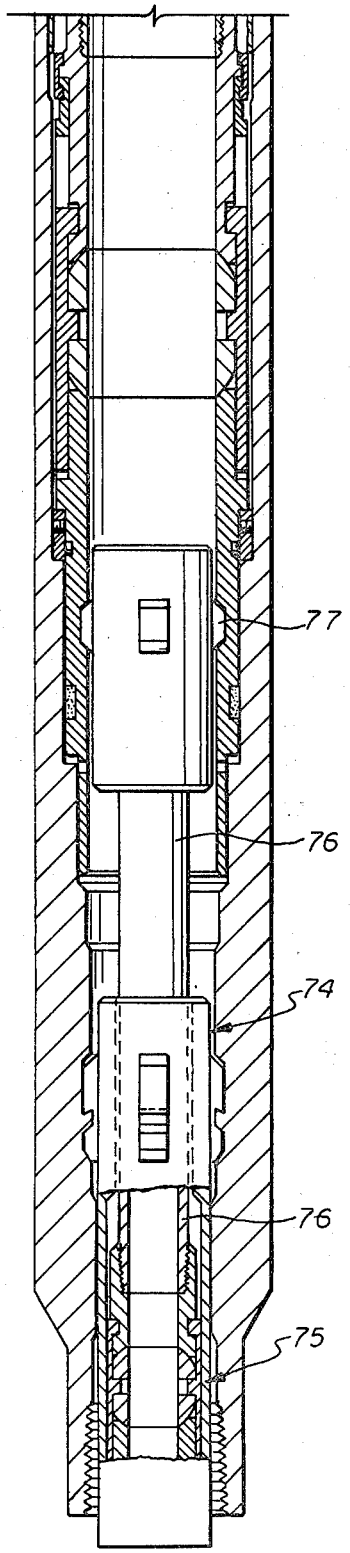

FIG. 5 is a fragmentary view on an enlarged scale of the valve actuator and the upper end of the sleeve of FIG. 4 latched together to permanently latch the valve in open position; and FIG. 6 is a view similar to FIG. 2C showing the valve to have been permanently latched in open position and a secondary valve to have been placed in the safety valve and latched to the actuator so that the safety valve actuator operates the actuator of a secondary valve.

Figure 1:
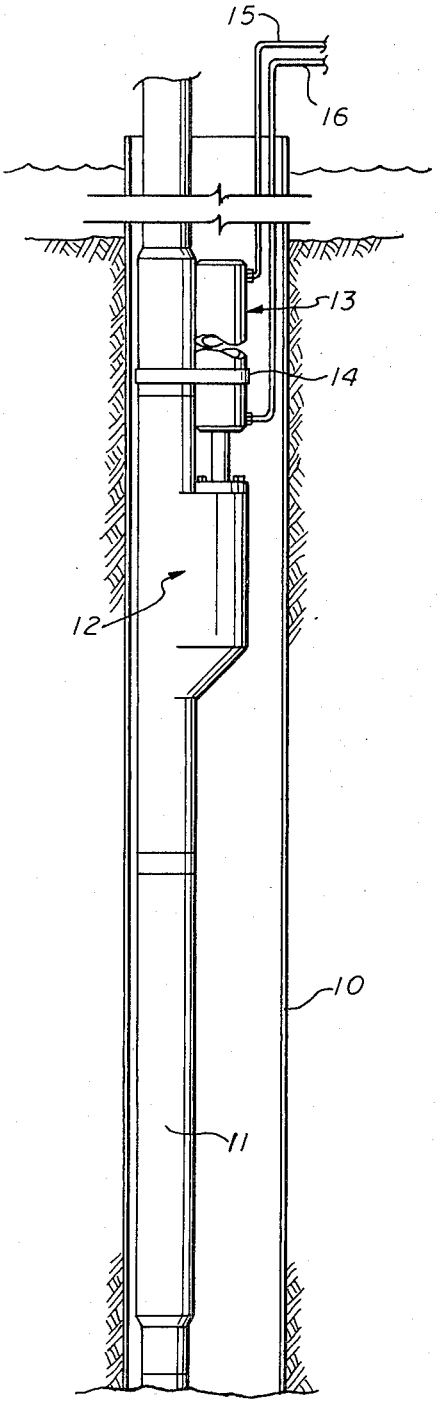
FIG. 1 is a schematic view of an offshore well equipped with the safety valve of this invention with the well string and safety valve shown in elevation.

Referring first to FIG. 1, an offshore well has a conventional casing 10. The details of the platform in which the casing terminates are not shown. Also, the controls, hydraulic pressure source and the like which will be incorporated with the system employing this valve are not shown. It is conventionally known to protect a well against happenings at the surface by utilizing a subsurface safety valve, and this conventional knowledge may be applied at the surface to actuate the safety valve in the event of any occurrence which endangers the well, such as collision of a vessel with the well.

The installation includes the conventional tubing 11 through which fluid from the formation is delivered to the surface. A suitable safety valve housing, indicated generally at 12, is connected in tubing 11. The housing includes an enlargement to which the reciprocating motor indicated generally at 13 is attached. The motor may additionally be strapped to the valve body by suitable strap 14. Hydraulic fluid for operating the motor is suitable through the two conduits 15 and 16. The motor 13 will have a piston and connecting rod therein and by control of the differential applied to the reciprocating motor through lines 15 and 16, the piston with its attached connecting rod may be reciprocated vertically up and down to control opening and closing of the safety valve of this invention. While the safety valve is shown to be positioned at approximately the mud line of an offshore completion, it will be appreciated that it may be positioned above or below this point. Also, the use of the reciprocating motor with its substantially equal heads of hydrostatic pressure exerted by the hydraulic fluids in lines 15 and 16 permits the safety valve to be positioned at any desired depth in the well and it is contemplated that the safety valve may be so positioned as well design dictates. It is also apparent that more than one safety valve could be utilized in a well design, if desired, and that the valve of this invention might be positioned at considerable depth in the well and a conventional safety valve employed adjacent the mud line. With the valve positioned adjacent the formation it is apparent that in addition to operating the safety valve upon the occurrence of some undesired phenomena the operator may readily open or close the safety valve by manipulation of the pressure of fluids in lines 15 and 16 and shut-in the well adjacent the producing formation. It will be understood by those skilled in the art that there is considerable advantage in being able to shut-in the well adjacent the formation at will.

The valve of this invention includes a housing which may be made up of several parts for convenience in manufacture and assembly. The housing includes the upper sub 17 threaded onto an upper tubular section 18 which includes the boss 19. A nipple 21 connects the intermediate tubular section 18 with a lower sub 22. At the upper end of the upper sub 17 and the lower end of the lower sub 22 threads are provided for connecting the valve in a tubing string in the conventional manner.

A valve member and valve seat indicated generally at 23 (FIG. 2C) controls flow through the tubular housing. The detail construction of this portion of the valve will be explained hereinbelow.

A valve actuator is provided for moving the valve member between open and closed position. This actuator in the illustrated valve is provided by a reciprocating member made up of upper sub 24 secured to two intermediate tubular sections 25 and **25*a* which carries at the lower end of section 25*a* a lower sub 26. The lower sub 26 has an external groove 27 which cooperates with the valve member and seat in a manner to be hereinafter explained. Also on the lower end of the lower actuator sub 26 the valve seat 28** is provided.

As will appear more fully hereinafter, the valve is provided with a lock-open feature and for this purpose a suitable tool receiving groove section indicated generally at 29 is provided in the lower end of the upper actuator sub 24.

When the valve is in closed position a seal is preferably provided between the actuator and the body. This may be provided by the upper surface **26*a* of lower sub 26 engaging a downwardly facing seat 21*a* on sub 21 (FIG. 2B). With these seat surfaces engaged flow between the housing and actuator is not permitted and by closing the flow passageway through the actuator the safety valve completely closes off flow from the well. Additionally, the resilient seal 31 between the nipple 21** and the actuator prevents such flow.

Suitable felt wipers **32*a*, 32*b*, 32*c*, and 32*d*** wipe the surfaces between the exterior of the actuator and the interior of the housing at appropriate locations.

Centralizing bearing 30 is provided on the upper sub 24.

As indicated above, the motor 13 is of the reciprocating type and may take any desired form in which a fluid motor controlled by fluids in conduits 15 and 16, reciprocates the connecting rod 33.

The housing is provided with the side boss 19 to which the motor has its lower housing 34 connected by suitable studs 35. The connecting rod 33 extends into the boss 19 and packing 36 seals between the boss and the reciprocating rod 32.

Means are provided for connecting the reciprocating rod 33 of motor 13 to the tubular section 25 of the actuator. This connection is a special connection which protects the system against the application of excessive forces. For instance, a substantially large differential may be applied across the piston in the motor 13 and such differential utilized in operating the motor. It is desirable, however, to insure that this large force not be applied to the actuator during normal operation. To insure that in the normal operation of the system the force on the connecting rod 33 is limited to a desired level, the connection between the connecting rod and the actuator is a yielding connection. Preferably a resilient connection is employed in which force is absorbed by the resilient connection and limits the force which is applied to the actuator. For instance, if a large differential is present across the valve member resisting opening of the valve member the connecting rod 33 can be moved by motor 13 to its full valve opening position and the amount of force applied to the actuator limited so that damage such as bending of the connecting rod 33 will not occur.

In the illustrated form of the invention the resilient connection between the actuator and the connecting rod includes a crosshead indicated generally at 37. The crosshead 37 has a bore 38 therethrough which has a sliding engagement with the outer surface of the intermediate section 25 of the actuator.

Means are provided between the actuator and crosshead to give a resilient connection between these parts during upward movement of the connecting rod 33 to move the valve between open and closed position. Preferably, a stop 39 is provided by a shoulder on the upper end of the intermediate actuator section 25. A resilient means such as spring 41 is held between the stop 39 and the crosshead 37.

In the preferred form the crosshead indicated generally at 37 is made up of two parts, one being a sliding sleeve **37*a* slidable on the actuator and a block 37*b* which is fixed to the connecting rod 33 and extends into a window 37*c* in the tubular section 37*a*** of the crosshead. This type of construction is desired in the illustrated embodiment to permit ease of assembly.

The resilient means such as spring 41 which is held between the crosshead 37 and stop 39 permits upward movement of the connecting rod 33 without accompanying movement of the actuator or opening of the valve member. As will be explained hereinbelow, such initial movement is utilized in another safety feature of this invention. The crosshead 37 may move upwardly to its maximum normal operating position and in this position an opening force is stored in the resilient spring 41 if the valve has not moved to its closed position. This may occur in the event of the valve or actuator sticking.

If desired a means may be provided to impose all of the force available to move the valve member from open to closed position in the event such movement is resisted. For instance if for some reason the actuator does not want to shift upwardly due to the actuator or valve being stuck in position, it may be desirable to apply additional force from the reciprocal motor and if the motor is designed to permit the application of additional force, a means can be provided for transmitting this force directly between the crosshead 37 and the actuator. For instance, the spring 41 could be designed to stack and after it has been collapsed by the ordinary range of movement of the crosshead 37 the collapsed spring would provide a solid metal-to-metal connection between the crosshead 37 and the actuator section 25. Thereafter any available amount of force could be applied through the connecting rod 33 to move the actuator upwardly and close the valve member.

In like manner, a resilient connection is provided between the crosshead and the actuator below the crosshead to provide for downward movement of the actuator. For this purpose the actuator 25 has an external shoulder 42 and a resilient member such as spring 43 is positioned between the crosshead 37 and the shoulder 42. On downward movement of the actuator, the resilient spring 43 is compressed and the force stored in the spring 43 is utilized to move the actuator downwardly and move the valve member from closed to open position. This spring protects the connecting rod 33 against the application of excessive force during the normal travel of the connecting rod. It sometimes occurs that a differential is present across the valve member which will prevent opening of the valve member with normal operation of the reciprocating motor. When this occurs the spring 43 will collapse and will be exerting an opening force on the valve member. The valve, however, will not open due to the differential thereacross until pressure within the tubing above the safety valve is increased to reduce this differential. When reduced to a suitable value the spring 43 may then extend to move the valve between closed and open positions. The spring also permits opening of the valve member by fluid pressure above the safety valve with the crosshead in valve closed position to permit pumping of fluid into the well through the valve member which will operate as a check valve.

With the valve in the open position it is desirable that the valve be locked in open position so that it cannot close except upon movement of the crosshead 37. When TFL (through-the-flow line) tools are pumped through the tubing they can possibly engage the actuator such as at the grooves 29 and inadvertently exert an upward force on the actuator. In accordance with this invention such upward force cannot move the valve member between open and closed position where it might close upon the tool string and the actuator will be held in open position while TFL tools are being pumped upwardly through the valve.

To prevent upward movement of the actuator by any means other than the crosshead 37, a suitable latch system is provided. This latch system is one which automatically engages when the valve moves to full open position and remains engaged until upward movement of the crosshead 37 releases the latch.

In the preferred form a collet indicated generally at 44 is carried by the nipple 21. The upstanding collet fingers **44*a* have downwardly facing shoulders 44*b*** which form a part of the latch system.

The lower end of the intermediate actuator section 25 is provided with an internal recess 45 and upwardly facing shoulders **45*a* in the recess. The upwardly facing shoulders 45*a* of the actuator engage the downwardly facing shoulders 44*b*** of the collet when the valve is in fully open position. Thus, the actuator is latched to the housing and cannot move upwardly under the influence of TFL tools being pumped upwardly through the valve and inadvertent closing of the valve upon an upwardly moving tool string therein is prevented.

The actuator latch is released by upward movement of the crosshead 37. For this purpose the crosshead carries a depending sleeve 46 which has an upwardly and outwardly inclined frustoconical surface **46*a* thereon. The collet fingers carry a release flange 44*c* having an upwardly and outwardly inclined frustoconical section 44*d* thereon which is engaged by the release cone 46*a* carried by the crosshead. Thus initial upward movement of the crosshead to compress the upper spring 41 moves the conical section 46*a* behind the matching section 44*d* on the collet fingers and collapses the collet fingers inwardly to release the shoulders 44*b* from the upwardly facing shoulders 45*a* to thus release the latch and permit the upper spring 41 to drive the actuator upwardly in response to upward movement of the crosshead 37** and move the valve from open to closed position.

While any desired valve member and seat of any desired form could be utilized, there has been provided a special valve assembly which may be assembled and adjusted as a subassembly. This subassembly obviously could be used advantageously with other subsurface safety valves. Conventionally valves are returned to the factory for replacement of damaged seats or valve members. With the assembly of this invention the subassembly which includes the valve member may be substituted in the field for another subassembly with assurance that the valve member will be in exact open position, that is, alignment with the passageway through the actuator so that tools cannot hang up on the valve member.

The subassembly (FIG. 2C) includes the lower actuator section 26, the cylindrical sleeve 47, the valve member 48 which is a ball valve in the form shown, and control arm means such as the pair of control arms **49*a* and 49*b***.

The upper ends of the control arms have in-turned projections **49*c* thereon which engage in groove 27 on the lower section 26 of the actuator and are reciprocated vertically by the actuator. A pivot means is provided between the ball valve 48 and these arms as by the pivot pins 51 and 52. These pins are received in suitable holes 53 and 54** in the ball valve member.

Figure 3:
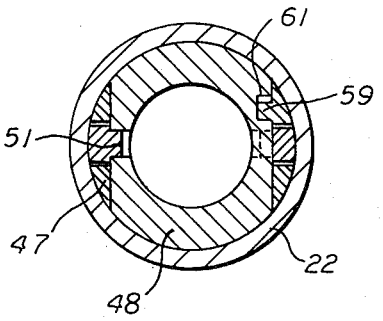
FIG. 3 is a sectional view along the lines 3—3 of FIG. 2C.

The sleeve 47 is shown in FIG. 4 to have a pair of opposed grooves 55 and 56 in which the control arms **49*a* and 49*b* reciprocate. Large opposed windows 57** and 58 are provided and the ball valve 48 extends into these windows. As best shown in FIG. 3 the sleeve 47 carries a pivot system which preferably is provided by the pivot pin 59 residing in a slot 61 in the ball valve 48. Thus, reciprocation of the control arms 49*a* and 49*b* causes the ball valve to move vertically within the housing and to rotate about the pivot pins 51, 52 and 59, as well as a complementary pin 60 (FIG. 4) on the other side of the ball which is identical to 59 positioned in a slot which is identical to 61. This vertical and rotational movement of the ball moves it between open and closed positions.

In accordance with this invention the assembly provided by the lower actuator section 26, the sleeve 47, arms 49*a* and *b* and the pivot system may be built as an assembly and may be machined to exactly position the valve in open position when the valve member is in engagement with the stop surface 62 provided at the lower ends of the windows 57 and 58. The preferred method of fabricating the assembly is to machine the downwardly facing surfaces of bosses 49*c* to a position in which when in place they hold the valve member 48 relative to seat 28 with extremely small clearance so that rotation of the valve member will wipe the ball against the seat and remove any undesirable materials thereon. This clearance may be on the order of less than one thousandth of an inch. With the ball valve in full open position and held against seat 28 by control arms 49*a* and *b* the stop surface 62 of sleeve 47 may be formed or machined to firmly engage the lower end of the ball 47 when the actuator firmly urges the ball downwardly. In other words as the ball is moved downwardly in the sleeve 47 the seat will urge the ball against the stop 62. The stop 62 will be cut away just enough to permit the ball to be moved downwardly about its pivot points to a point at which the bore through the ball valve member 48 is exactly in alignment with the bore through the actuator and through the sleeve section 47 to provide a smooth continuation thereof so that tools passing through the valve will not hang up on the valve.

With this construction it will be apparent that the subassembly can be fabricated separately from the remainder of the valve and can be replaced in the field with the ball always moving to exact open position with downward movement of the actuator. This avoids having to return the entire valve to the factory for replacement of the valve member or its seat.

Desirably, the safety valve is capable of being locked in the open position and of receiving a secondary valve which can be operated by the reciprocal motor 13 so that if desired a secondary valve can be run in place and utilized as a substitute for the safety valve in the event of a damaged valve or seat. This feature is of advantage where it is desirable not to have to pull the tubing string to replace the valve and seat of the safety valve.

In accordance with this invention the main valve member 48 is locked in open position without interfering with the ability of the actuator to reciprocate in response to reciprocation of the connecting rod 33 by the reciprocating motor 13. Preferably, the secondary valve is placed below the interface between the safety valve and the reciprocating motor and where this preferred form of placement is utilized the actuator arm is preferably shifted a distance beyond the usual operating distance to actuate lockout. In the preferred embodiment, this additional shifting distance is utilized to latch the actuator arm to the valve carrying sleeve 47 and reciprocate the valve carrying sleeve and actuator as a unit. As the relative movement between the sleeve 47 and actuator 26 is then prevented the valve 48 will be maintained in its open position.

In the preferred form the sleeve is also released from the housing at the same time so that the latched sleeve and actuator may move as a unit.

In FIG. 2C it will be noted that the sleeve is held in position by a ring 63 which is secured to the sleeve by pin 64. The ring bears against shoulder 65 in the housing and holds the sleeve 47 against downward movement. When the actuator is forced to move beyond the normal valve closing position shear pins 64 are sheared and the sleeve is thereafter free to move with the actuator.

The means for latching the actuator and sleeve together is shown enlarged in FIG. 5. The lower section 26 of the actuator is reciprocal in the upper end of the sleeve 47. As shown best in FIG. 4 the upper end of sleeve 47 has an annular groove 66 therein. Overlying the section of the sleeve which contains the annular groove is a split ring 67 which in its normal relaxed condition is contracted in the position shown in FIG. 5. In the FIG. 2C position, the ring is shown to be held in its expanded position and is inoperative as a latch. It does function, however, to hold the sleeve 47 in its down position by bearing against the shoulder 68 on sleeve 47 and in turn being held against upward movement by a cylindrical stop 69 which extends upwardly and abuts the lower end of the nipple 21.

The lower section 26 of the actuator is provided with an upwardly facing shoulder 71 and this shoulder, together with the downwardly facing shoulder provided by the groove 66, is utilized in latching the actuator and sleeve together. It will be noted that the ring 67 is U-shaped in cross-section with the concave portion of the U facing inwardly. Thus, opposed shoulders 67*a* and *b* are provided on ring 67 and are dimensioned to cooperate with shoulder 71 on the lower section of the actuator and the shoulder provided by the groove 66 on the sleeve to latch these two parts together. Thus, when the actuator 26 is moved downwardly by shearing of pin 64, the snap ring 67 moves into a position in which its internally protruding flanges at its upper and lower position are spaced one within the groove 66 and one above the shoulder 77, thus permitting the snap ring to contract out from under the sleeve 69 into the position shown in FIGS. 5 and 6 to latch the actuator and sleeve 47 to each other. Thereafter reciprocation of the actuator by the crosshead 37 will reciprocate the actuator sleeve and ball as a unit with the ball valve in full open position. Any desired means can be provided for shifting the actuator sleeve downwardly past its normal operating position to shear the pins 64. For example, a tool may be run into the well and landed in the grooves in the upper section 24 of the actuator. This tool can then be forced down by fluid pressure to force the actuator downwardly and shear pins 64 to latch the actuator and valve carrying sleeve in a position in which the valve is locked in the open position.

In accordance with this invention provisions are made for a secondary valve to be run into the well and to be operated by reciprocation of the crosshead 37 and the actuator. For this purpose the lower sub 22 is provided with a suitable locking groove configuration 72 and the lower section of the sleeve 47 is provided with a locking groove 73.

After the actuator and sleeve have been latched together and the operative tools removed from the well a secondary valve indicated generally at 74 is run into the well and is latched into the housing grooves 72. This secondary valve will include a ball valve indicated generally at 75 which is moved between open and closed position by reciprocation of the secondary valve actuator 76.

The secondary valve actuator will be landed in the groove 73 by suitable dogs 77 and thus reciprocation of the crosshead 37 will be transmitted through the actuator and the sleeve 47 to the actuator 76 of the secondary valve and reciprocation of the actuator 76 will thus move the secondary valve between open and closed position to control flow from the well. Suitable seals, not shown, will be provided between the secondary valve and the housing 22 so that all flow must channel through the secondary valve.

In operation the safety valve will be made up on the tubing string in the usual manner and will normally be in the open position shown during normal production of the well. Upon the happening of some occurrence at the surface or at the will of the operator the reciprocating motor 13 will be shifted by control of the differential in pressure in lines 15 and 16 to raise connecting rod 33 and move the crosshead 37 upwardly. Force will be transmitted through the spring 41 to the actuator which will in turn move the valve member from open to closed position. The spring will prevent the occurrence of excessive force on the connecting rod 33. When desired the valve can be reopened by operating the motor 13 to move the crosshead 37 downwardly to open the valve.

If damage occurs to the valve and it is desired to land an auxiliary or secondary valve to control flow through the well, a tool is run in and landed in the actuator in the landing section 29 and a downward force applied to the actuator to shear pins 64 and to move the actuator down relative to the sleeve 47 to permit the split ring 67 to collapse inwardly and secure the sleeve 47 and the actuator section 26 together as best shown in FIGS. 5 and 6.

Thereafter a secondary valve is run in and the valve is landed in landing grooves 72 in the housing and the actuator is landed in grooves 73 in the valve actuator. Thereafter, reciprocation of the crosshead and valve actuator will reciprocate the actuator of the secondary valve and move it between open and closed positions to control flow through the well.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A valve comprising, a housing, a valve member and valve seat controlling flow through said housing, an actuator moving said valve member between open and closed positions with reciprocation of said actuator, a crosshead slidably mounted on said actuator and adapted for attachment to the reciprocating rod of a reciprocating motor, spaced stops on said actuator, and resilient means on said actuator on opposite sides of said crosshead, said resilient means confined between said crosshead and said stops and transmitting movement of said crosshead in opposite directions to said actuator, said resilient means permitting the crosshead to slide along said actuator and prevent excessive force from being applied to said actuator by said crosshead during normal operation of the valve.

2. The valve of claim 1 wherein said resilient means is provided by springs, and wherein a solid force transmitting linkage is provided between said crosshead and said actuator after said crosshead has moved as selected distance in either of said directions.

3. A valve comprising, a housing, a valve member and valve seat controlling flow through said housing, an actuator moving said valve member between open and closed positions with reciprocation of said actuator, a crosshead slidably mounted on said actuator and adapted for attachment to the reciprocating rod of a reciprocating motor, means between said crosshead and said actuator for moving said actuator to valve opening position with movement of said crosshead in one direction, a stop on said actuator, and resilient means between said stop and crosshead urging said actuator to valve closing position with movement of said crosshead in the other direction, said resilient means permitting the crosshead to slide along said actuator and prevent excessive force from being applied to said actuator by said crosshead during normal closing operation of the valve.

4. The valve of claim 3 wherein a solid force transmitting linkage is provided between said crosshead and said actuator after said crosshead has moved a selected distance in said other direction.

5. The valve of claims 1 or 3 wherein latch means is provided between said housing and said actuator which is moved to latched position by movement of said actuator to valve open position to positively latch the valve in open position and prevent inadvertent closing of the valve by an upward force applied to the actuator other than by the crosshead, and means on said crosshead for unlatching said latch means upon initial movement of said crosshead in said other direction from valve open position.

6. The valve of claims 1 or 3 wherein a collet having a latch shoulder is carried by one of said housing and said actuator and a complementary latch shoulder is carried by the other of said housing and said actuator automatically engaging each other as the valve member moves into open position, and latch release means carried by said crosshead disengaging said shoulders upon initial movement of said crosshead from valve open position toward valve closed position.

* * * * *